US008601911B1

(12) United States Patent
Baryam

(10) Patent No.: US 8,601,911 B1
(45) Date of Patent: Dec. 10, 2013

(54) TONG ASSEMBLY FOR MANIPULATING A TUBULAR

(75) Inventor: Jacob Baryam, Houston, TX (US)

(73) Assignee: Scorpion Oil Tools, Inc., Houston, TX (US)

( * ) Notice: Subject to any disclaimer, the term of this patent is extended or adjusted under 35 U.S.C. 154(b) by 279 days.

(21) Appl. No.: 13/302,554

(22) Filed: Nov. 22, 2011

(51) Int. Cl.
*E21B 19/16* (2006.01)
*B25B 13/50* (2006.01)

(52) U.S. Cl.
USPC ..... 81/57.34; 81/57.15; 81/57.2

(58) Field of Classification Search
USPC ..... 81/57.15, 57.17, 57.22, 57.24, 57.3, 81/57.32, 57.33, 57.34, 57.35
See application file for complete search history.

(56) References Cited

U.S. PATENT DOCUMENTS

| | | | | |
|---|---|---|---|---|
| 5,653,297 | A * | 8/1997 | Whisenhunt | 175/52 |
| 5,785,132 | A * | 7/1998 | Richardson et al. | 175/57 |
| 6,065,372 | A * | 5/2000 | Rauch | 81/57.15 |
| 7,997,167 | B2 * | 8/2011 | Kruse et al. | 81/57.34 |
| 8,496,238 | B1 * | 7/2013 | Orgeron | 269/270 |

* cited by examiner

*Primary Examiner* — David B Thomas
(74) *Attorney, Agent, or Firm* — Buskop Law Group, PC; Wendy Buskop

(57) ABSTRACT

A tong assembly from manipulating a tubular, wherein, the assembly has a make-up/break-out arm or a backup arm. The make-up/break-out arm or backup arm engages a tubular. The make-up/break-out arm or backup arm is connected with one or more cylinders grips the tubular using either rocker jaws or chain links containing tong dies.

19 Claims, 14 Drawing Sheets

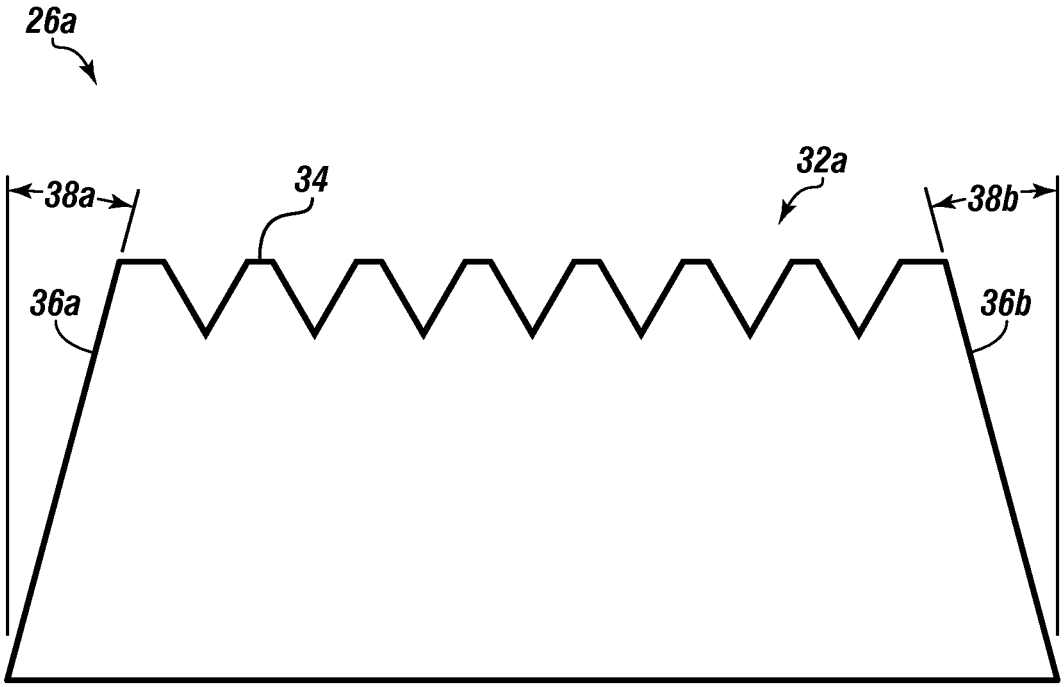
FIGURE 3B
FIGURE 3C
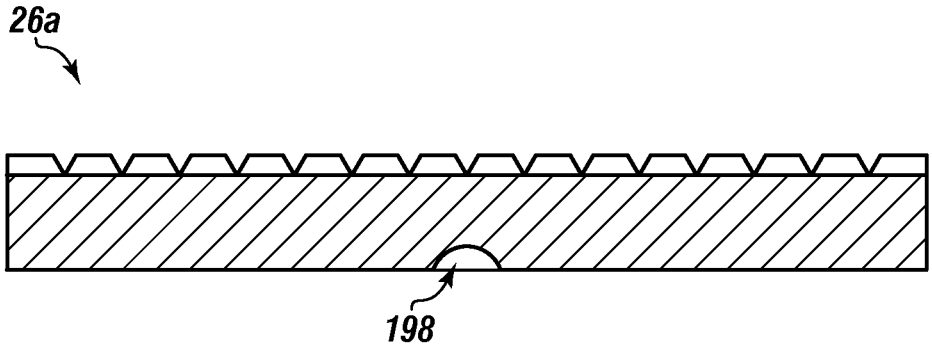

TONG ASSEMBLY FOR MANIPULATING A TUBULAR

FIELD

The present embodiments generally relate to a tong assembly for use in makeup or break-out of a tubular.

BACKGROUND

A need exists for a tong assembly for making-up or breaking-out a tubular that can be used with limited training or expertise.

A further need exists for a tong assembly that can be used to automatically break-out or make-up tubulars with minimal risk and minimal human interaction.

A further need exists for a tong assembly that does not require readjustment during the make-up or break-out procedure due to rolling off center of the tubular when the jaw connects with the tubular.

The present embodiments meet these needs.

BRIEF DESCRIPTION OF THE DRAWINGS

The detailed description will be better understood in conjunction with the accompanying drawings as follows:

FIG. 3B depicts a close up view of a tong die according to one or more embodiments.

FIG. 3C depicts a cut view of the tong die according to one or more embodiments.

Figure 1:
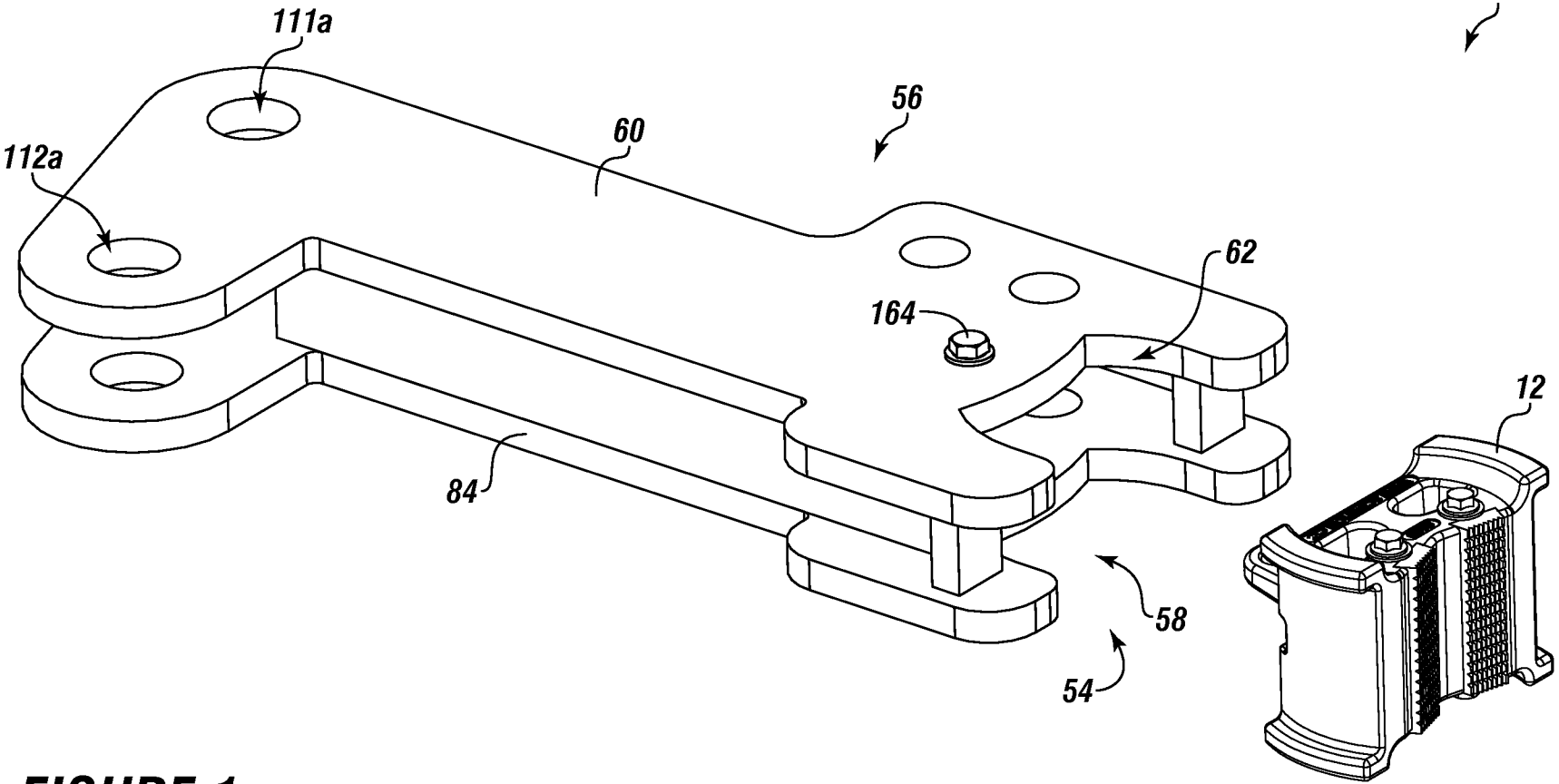
FIG. 1 depicts a make-up/break-out arm according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments generally relate to a tong assembly with a make-up/break-out arm, which can be spaced apart from a backup arm. The make-up/break-out arm, the backup arm or combinations thereof, can engage a tubular.

The tong assembly can have an automated make-up or break-out procedure, such as a remote control which actuates the cylinders, eliminating the loss of extremities due to injury from manual tongs.

The tong assembly can prevent work slows by replacing manual tongs, leading to overall employment growth. The tong assembly can prevent layoffs or employee replacement by preventing injuries that can require hospitalization.

The tong assembly can have a design which internally dissipates energy, aiding in the prevention of violent energy releases that can lead to oil spills.

The tong assembly can be extremely portable and require little extra equipment, which can allow water well drilling to be done safely by low skill individuals in remote towns and villages.

The tong assembly can have a specialized design, which can prevent the use of dangerous equipment, which is not designed for the purpose of make-up or break-out, from being used such as overhead cranes with cables.

The make-up/break-out arm can include a rocker jaw, which can include a rocker jaw body.

The rocker jaw body can include a face, which can have one or more tong die grooves.

The tong die grooves can have groove edges, which can incline towards a center line as the groove edges extend from the rocker jaw body, such as at a 75 degree angle.

The face can have a facial radius, which can be large enough to accommodate the tubular, such as a facial radius which can be between about 2 inches to about 60 inches.

The rocker jaw body can include a tong die which can be in one or more of the tong die grooves, such as a rocker jaw body with two tong dies filling two tong die grooves.

The tong die can include one or more tooth beds. The tooth beds can support a plurality of teeth, which can extend from the tooth bed.

Though described and shown with teeth, the tong die does not necessarily have teeth. The tong die used here is envisioned to be any tong die that is available for use in the make-up or break-out of tubulars.

The plurality of teeth can be used for gripping the tubular and can be of various shapes and spacing, such as pyramid shaped teeth spaced equidistant from one another with 8 rows and 16 columns of teeth total.

The tong die can include tooth bed edges. The tooth bed edges can have a slope, such as a slope of about 75 degrees. The slope of the tooth bed edges can provide a flush fit with the groove edges.

The tong die does not necessarily have teeth. The tong die used here is envisioned to be any tong die that is available for use in the make-up or break-out of tubulars.

The tooth bed edges can also have a T-formation.

The tong die can have a holding means which can provide a holding compression. The holding compression can prevent the tong die from sliding out of its tong die groove. The holding means can be a detent, such as a spring and ball.

The rocker jaw body can have a first side pair of flanges which can extend from the rocker jaw body. The rocker jaw body can have a second side pair of flanges which can extend from the rocker jaw body. Each flange can be curved and can resist deformation during movement, such as a flange made of steel.

The rocker jaw body can have an arm frame. The arm frame can have a rocker recess which can have concave edges.

A tail can extend from the rocker jaw body. The tail can have a tail hole. The rocker jaw body can have an outer radius which can allow for proper resting of the jaw in the arm frame.

The outer diameter can provide a flush fit between the rocker jaw body and concave edges of a rocker recess of an arm frame.

The arm frame can include a top plate, which can include a top rocker recess portion. The top rocker recess portion can include a first straight edge portion. The first straight edge portion can be connected with a first concave edge portion, such as the first straight edge portion making a direct connection to the first concave edge portion.

The top rocker recess portion can include a second straight edge portion. The second straight edge portion can be connected with a second concave edge portion.

The top rocker recess portion can have a concave edge radius for each concave edge portion. The concave edge radius can be of any range to fit the rocker jaw, such as a concave edge radius of about 3 inches.

The top rocker recess portion can have a convex edge which can be located between the first and second concave edge portions. The convex edge can have a convex edge radius. The convex edge radius can be of any range to fit the rocker jaw, such as about 7 inches.

The top plate can have a top fastening hole. The fastening hole can be located near the top rocker recess portion, such as a fastening hole located about 2 inches from the top rocker recess portion.

The top plate can have one or more pin holes. The one or more pin holes can accept pins.

The pins can secure an L-link or an adjustable link to the rocker arm, such as the adjustable link secured to a rocker arm to allow for a more adjustable grip on the tubular.

The arm frame can have a bottom plate. The bottom plate can have a bottom rocker recess portion.

The bottom rocker recess portion can have a first straight edge portion. The first straight edge can connect with a first concave edge portion.

The bottom rocker recess portion can have a bottom second straight edge portion. The bottom second straight edge can connect with a bottom second concave edge portion.

The bottom plate can have a concave edge radius for each edge portion. The concave edge radius can be range from about 2 inches to about 6 inches.

The bottom plate can have a convex edge. The convex edge can be disposed between the first and second concave edge portions. The convex edge can have a convex edge radius, such as a convex edge radius from about 4 inches to about 12 inches.

The bottom plate can have a bottom fastening hole. The bottom fastening hole can be located near the bottom rocker recess.

The bottom plate can have one or more pin holes. The one or more pin holes can accept the pins. The pins can be used to secure the rocker arm to an L-link or an adjustable link.

The bottom plate can have spacing bars which connect with and separate the top plate and bottom plate. The spacing bars can align the holes and openings.

A side support plate can be connected between the top plate and bottom plate.

The bottom plate can have a break-out cylinder connecting hole. The break-out cylinder connecting hole can be used to support a break-out cylinder.

The bottom plate can have a chain cylinder connecting hole. The chain cylinder connecting hole can be used to support a chain cylinder.

The make-up/break-out arm can have a plate jaw fastener. The plate jaw fastener can be inserted through the top fastening hole and the bottom fastening hole. The plate jaw fastener can retain the rocker jaw between the top and bottom plate by engaging the tail hole of the rocker jaw body.

The make-up/break-out arm can have one or more cylinder connecting pins. The cylinder connecting pins can be used to connect a floating arm to a break-out cylinder.

Though depicted here with cylinders as the mechanism for applying force, it is envisioned that, in one or more embodiments, the force can be applied using a screw mechanism or other manual means.

The radius of the convex edges of the top rocker recess and the bottom rocker recess can allow self-centering of the arm rocker jaw in the rocker recesses.

The backup arm can include a backup rocker jaw. The backup rocker jaw can include a backup rocker jaw body.

The backup rocker jaw body can include a backup face. The backup face can have one or more backup tong die grooves. The backup tong die grooves can have one or more backup groove edges. The backup groove edges can extend from the backup rocker jaw body.

The backup face can have a backup facial radius, such as a backup facial radius of about 2 inches to about 60 inches.

The backup rocker jaw body can have one or more backup tong dies, which can reside in the one or more backup tong die grooves.

The backup tong dies can have one or more backup tooth beds. The backup tooth beds can support a plurality of backup teeth. The backup teeth can extend from the backup tooth bed for gripping the tubular.

The backup tooth bed can have backup tooth bed edges. The backup tooth bed edges can have a backup slope. The backup slope can provide a flush fit with the backup groove edges which can incline towards a backup center line.

The backup face can have a backup holding means for each backup tong die. The backup holding means can provide a holding compression to prevent the backup tong die from sliding out of the backup tong die groove. The backup holding means can be a detent, such as a spring and ball.

A first side pair of backup flanges can extend from the backup rocker jaw body. A second side pair of backup flanges can extend from the backup rocker jaw body. Each backup flange can be curved and move without deformation.

The backup rocker jaw body can have a backup tail, which can have a backup tail hole.

The backup rocker jaw body can have a backup outer diameter. The backup outer diameter can provide a flush fit between the backup rocker jaw body and backup concave edges of a backup rocker recess of a backup arm frame.

The backup arm frame can include a backup top plate. The backup top plate can have a backup top rocker recess portion.

The backup top rocker recess portion can include a first backup straight edge portion. The first backup straight edge portion can connect with a first backup concave edge portion.

The backup top rocker recess portion can include a second backup straight edge portion. The second backup straight edge portion can connect with a second backup concave edge portion.

The backup concave edge portions can have a backup concave edge radius. The backup concave edge radius can be of any size which can allow for proper resting of the jaw in the rocker recess, such as about 3 inches.

A backup convex edge can be disposed between the first and second backup concave edge portions. The backup convex edge can have a backup convex edge radius which can be of any size which can allow for proper resting of the jaw in the rocker recess, such as a backup convex edge radius of about 7 inches.

The backup top plate can have a backup top fastening hole. The backup top fastening hole can be located near the backup top rocker recess portion, which can be used to hold a rocker jaw of one or more designs.

The backup top plate can have one or more backup pin holes. The backup pin holes can accept one or more pins. The pins can secure the L-link or the adjustable link to the backup rocker arm.

The backup arm frame can have a backup bottom plate. The backup bottom plate can have a backup bottom rocker recess portion, which can both support and hold the rocker jaw.

The backup bottom rocker recess portion can have a backup bottom first straight edge portion. The backup bottom first straight edge portion can connect with a backup bottom first concave edge portion.

The backup bottom rocker recess portion can have a backup bottom second straight edge portion. The backup bottom second straight edge portion can connect with a backup bottom second concave edge portion.

The backup bottom rocker recess portion can have a backup bottom concave edge radius for each backup bottom edge portion. The backup bottom concave edge radius can of any size which can allow for proper resting of the jaw in the rocker recess, such as a backup concave edge radius of about 3 inches.

The backup bottom rocker recess portion can have a backup bottom convex edge disposed between the backup bottom first and bottom second concave edge portions. The backup bottom convex edge can have a backup bottom convex radius, such as a backup convex edge radius of about 4 inches to about 12 inches.

The backup concave and convex edges can create a structural support for the rocker jaw, which can allow for the application of force on the rocker jaw, such as from an actuating chain cylinder.

The backup bottom plate can have a backup bottom fastening hole located next to the bottom rocker recess portion.

The backup bottom plate can have one or more backup pin holes. The backup pin holes can accept the pins. The pins can secure the L-link or the adjustable link to the backup rocker arm.

The backup bottom plate can have spacing bars connected with and separating the backup top plate and backup bottom plate. The spacing bars can align the holes and openings of the backup top plate and the backup bottom plate.

The backup bottom plate can have a backup side support plate, which can be connected with the backup top plate and the backup bottom plate.

The backup bottom plate can have a backup back support plate, which can be connected with the backup top plate and the backup bottom plate.

The backup bottom plate can have a first backup angled support and a second backup angled support. The first backup angled support and the second backup angled support can be connected with and separating the backup top and backup bottom plates.

The backup arm frame can have a backup top chain cylinder connecting hole in the backup top plate and a backup bottom chain cylinder connecting hole in the backup bottom plate. The backup top chain cylinder connecting hole and the backup bottom chain cylinder connecting hole can support the chain cylinder.

The plate jaw fastener can retain the rocker jaw body between the top and bottom plate by engaging the tail hole of the tail of the rocker jaw body. Retaining the rocker jaw on a single bolt can allow the rocker jaw to be mobile within the space dedicated by the arm frame.

The radius of the convex edges of the backup top rocker recess and the backup bottom rocker recess can allow self-centering of the backup arm rocker jaw in the backup rocker recesses.

The tong assembly can further include an L-link connected with the rocker arm.

In one or more embodiments, a connecting link can attach chain links to the L-link. In one or more embodiments, the chain links can be connected in series which can be used for connecting around a tubular outer diameter.

The rocker jaw can also include the first pair of side flanges and the second pair of side flanges where each flange can have bevels at the base. The flange can allow the rocker jaw to move in the arm frame to hold the tubulars, such as during make-up and break-out.

The rocker jaw can include a plurality of teeth where the teeth have a pyramidal shape, which can be used to decrease surface area to prevent scarring of the tubular during break-out or make-up.

The rocker jaw can include a face which has three parallel tong die grooves with a tong die in each tong die groove.

The rocker jaw can include a holding means, such as a detent or a fastener.

The rocker jaw can include the first pair of side flanges and the second pair of side flanges which are connected with an outside surface of the top plate and the bottom plate or connected with the an inside surface of the top plate and the bottom plate.

The rocker jaw can include a rocker jaw body with a first body cavity and a second body cavity. The first and second body cavity can extend from a top side into the rocker jaw body.

The rocker jaw can include a rocker jaw body with a third body cavity and a fourth body cavity. The third and fourth body cavity can extend from a bottom side into the rocker jaw body.

The rocker jaw can have one or more tong dies which also have a depression in a back side. This depression can be used for containing the holding means.

The tong assembly can also have an L-link connected with the arm frame, wherein a connecting link attaches one or more chain links connected in series to the L-link. The chain links can be connected directly to the arm, without the use of the L-link.

The chain links can be connected with a locking link to a chain cylinder for connecting around a pipe outer diameter.

The chain cylinder can connect between the top plate and the bottom plate using the cylinder connecting pin.

Each chain link can include a chain link face, a chain link back, at least one tong die groove formed in each chain link face having groove edges that incline towards each other, and a tong die in each of the tong die grooves.

The tong die grooves of the chain link can include at least one tooth bed supporting a plurality of teeth extending from the tooth bed, such as pyramidal teeth for use in gripping tubular.

The tooth bed can have tooth bed edges which have a slope to provide a flush fit with the groove edges.

The tong assembly can include a connecting link which is connected to the L-link with a first hinge pin. The L-link can connect with the chain link with a second hinge pin.

The tong assembly can include an L-link which can connect between the top plate and the bottom plate using the accepting pins.

The tong assembly can include a break-out cylinder which can be connected between the top plate and the bottom plate using the cylinder connecting pin.

The tong assembly can include a plurality of handles. The handles can be attached with the chain links, the connecting link or the locking link which can be connected with the arm frame, wherein the connecting link attaches one or more chain links.

The tong assembly can include a handle which includes an upper handle plate with an upper flat edge, and a lower handle plate with a lower flat edge.

The tong assembly can include a handle with an attachment plate integral with the upper flat edge and the lower flat edge. The attachment plate can extend between the upper handle plate and the lower handle plate.

The tong assembly can include a handle with a gripping post which can be affixed between the upper handle plate and the lower handle plate.

The tong assembly can include chain links connected in series to the L-link. The chain links can be connected using hinge pins.

The tong assembly can include hinge pins which can be affixed using a crown bolt and cotter pin.

The tong assembly can include a chain cylinder which includes a slidable hydraulically actuated piston rod.

The tong assembly can include a break-out cylinder which includes a slidable hydraulically actuated piston rod.

Either arm frame can include a side support plate, which can be connected between the top and bottom plates.

In practice, one or more embodiments can be designed to automatically reposition the rocker jaw to properly make contact between the tong dies and the tubular when the tong assembly is connected with the tubular, such as to prevent rolling of the tubular out of the jaw center.

Turning now to the Figures, FIG. 1 depicts a make-up/break-out arm 6 according to one or more embodiments.

The make-up/break-out arm 6 can include an arm frame 56 and a rocker jaw 12.

The arm frame 56 can include a top plate 60 and a bottom plate 84.

The top plate 60 can include a break-out cylinder connecting hole 111*a* and a chain cylinder connecting hole 112*a*, which can be used to connect to a break-out cylinder and a chain cylinder respectively.

The top plate 60 can have a top rocker recess portion 62. The bottom plate 84 can have a bottom rocker recess portion 58.

The arm frame 56 can have a rocker recess 54 formed between the top rocker recess portion 62 and the bottom rocker recess portion 58.

The rocker jaw 12 can be positioned in the rocker recess 54. The rocker jaw 12 can be attached to the arm frame 56 using a plate jaw fastener 164.

Figure 2A:
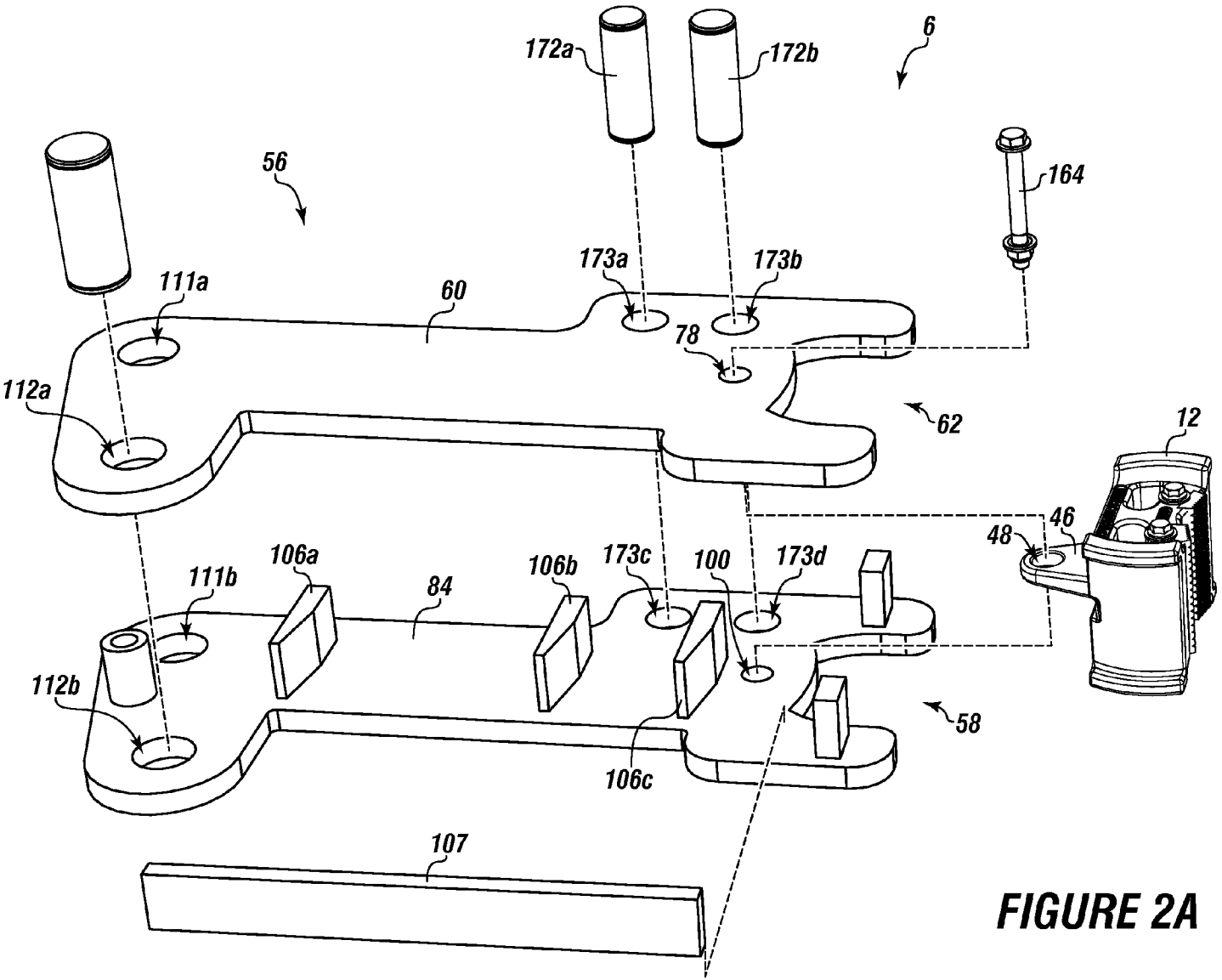
FIG. 2A depicts an exploded view of a make-up/break-out arm according to one or more embodiments

FIG. 2A depicts an exploded view of the make-up/break-out arm 6 according to one or more embodiments.

The make-up/break-out arm 6 can have the arm frame 56. The arm frame 56 can have the top plate 60 and the bottom plate 84. The top plate 60 can have the top rocker recess portion 62.

The top plate can have a top fastening hole 78 located next to the top rocker recess portion 62.

The top plate 60 can have a plurality of pin holes 173*a* and 173*b* for each accepting pins 172*a* and 172*b*.

The top plate 60 can have a break-out cylinder connecting hole 111*a* for supporting a break-out cylinder. The top plate can have a chain cylinder connecting hole 112*a* for supporting a chain cylinder.

The bottom plate 84 can have a bottom rocker recess portion 58. The bottom plate 84 can have a bottom fastening hole 100 located next to the bottom rocker recess.

The bottom plate can include a plurality of pin holes 173*c* and 173*d* for accepting the pins 172*a* and 172*b*.

The bottom plate can include spacing bars 106*a*, 106*b*, and 106*c*. The spacing bars 106*a*, 106*b*, and 106*c* can be positioned to separate the top and bottom plates, which can align the holes and openings between the top plate 60 and bottom plate 84.

The bottom plate 84 can also have a side support plate 107, which can connect between the top plate 60 and the bottom plate 84.

The bottom plate 84 can have a break-out cylinder connecting hole 111*b* for supporting a break-out cylinder. The bottom plate can have a chain cylinder connecting hole 112*b* for supporting a chain cylinder.

The rocker jaw 12 can have a tail 46. The tail 46 can have a tail hole 48. The plate jaw fastener 164 can connect with the rocker jaw 12 through the tail hole 48 in the tail 46.

The rocker jaw 12 can be connected between the top plate 60 through the top fastening hole 78 and the bottom plate 84 through the bottom fastening hole 100 using the plate jaw fastener 164.

Figure 2B:
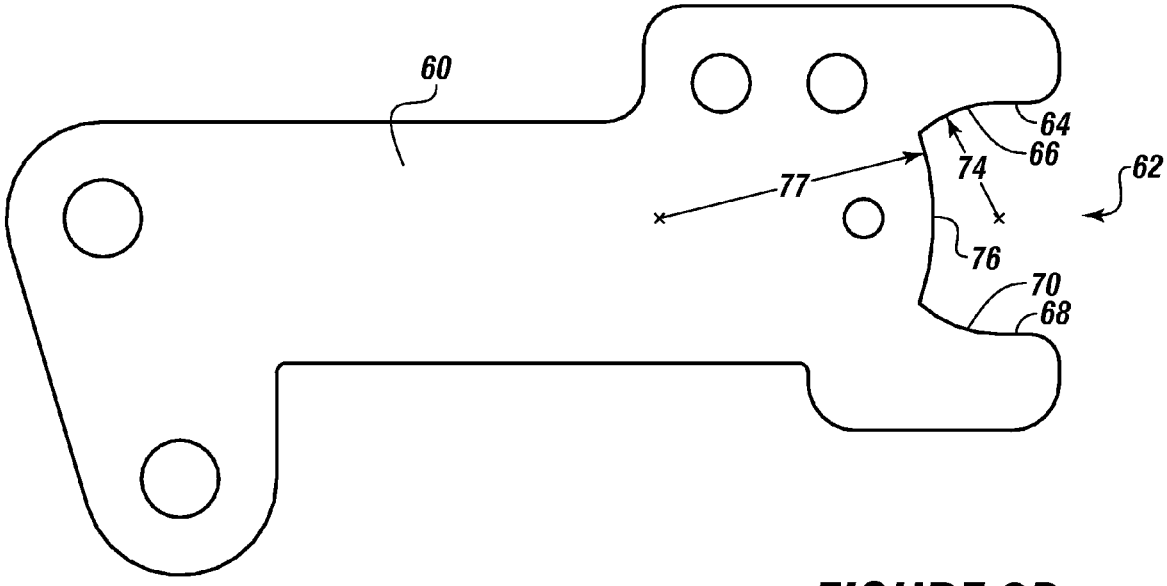
FIG. 2B depicts a top view of the top plate according to one or more embodiments.

FIG. 2B depicts a top view of the top plate 60 according to one or more embodiments.

The top plate 60 can have the top rocker recess portion 62. The top rocker recess portion 62 can include a first top straight edge portion 64 sequentially connecting with a first top concave edge portion 66.

The top rocker recess portion 62 can include a second top straight edge portion 68 sequentially connecting to a second top concave edge portion 70.

The top rocker recess portion can have a top concave edge radius 74 for each top concave edge portion.

The top rocker recess portion can include a top convex edge 76 positioned between the first and second top concave edge portions. The top convex edge can have a top convex edge radius 77.

Figure 2C:
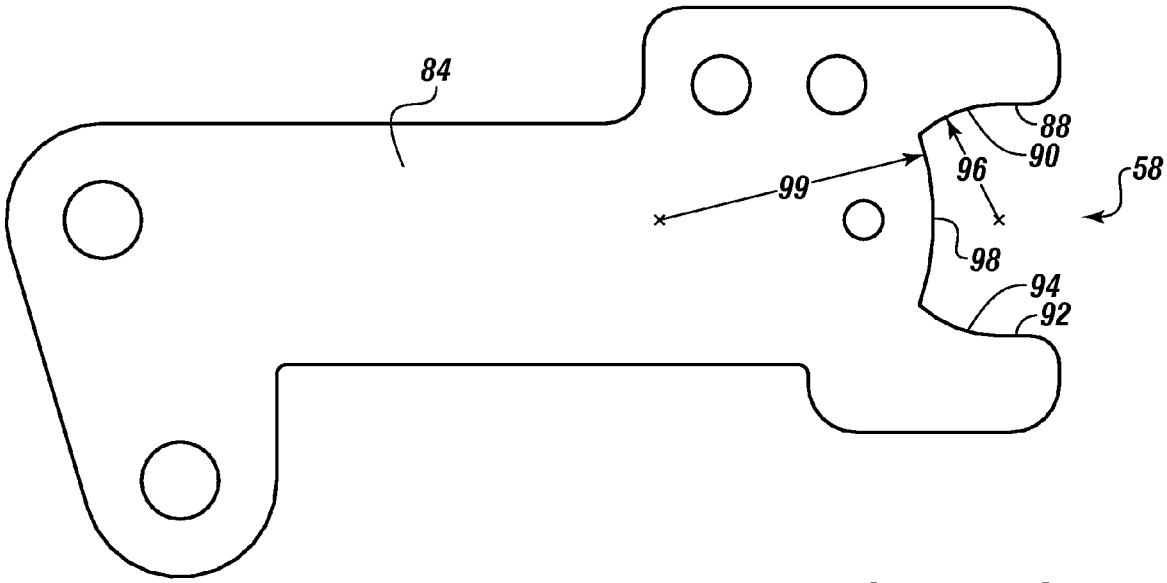
FIG. 2C depicts the bottom plate according to one or more embodiments.

FIG. 2C depicts a top view of the bottom plate 84 according to one or more embodiments.

The bottom plate 84 can have the bottom rocker recess portion 58. The bottom plate 84 can have a first bottom straight edge portion 88 connecting with a first bottom concave edge portion 90.

The bottom plate 84 can have a second bottom straight edge portion 92 connecting with a second bottom concave edge portion 94.

The bottom plate 84 can have a bottom concave edge radius 96 for each bottom concave edge portion.

The bottom plate 84 can have a bottom convex edge 98 located between the first and second bottom concave edge portions. The bottom convex edge 98 can have a bottom convex edge radius 99.

Figure 3A:
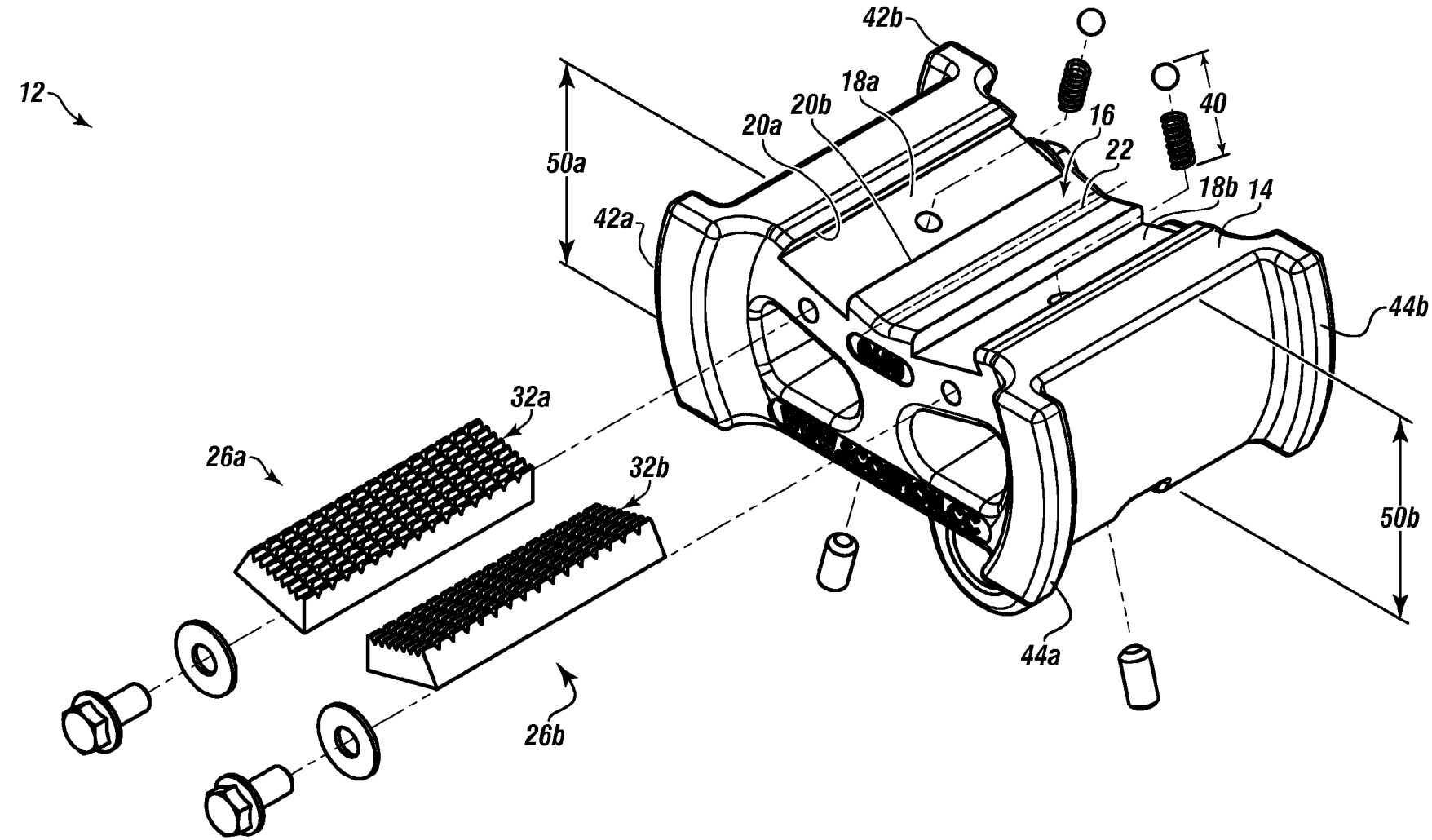
FIG. 3A depicts a two tong die rocker jaw according to one or more embodiments.

FIG. 3A depicts a two tong die rocker jaw according to one or more embodiments, depicted here as the rocker jaw 12.

The rocker jaw 12 can have a rocker jaw body 14. The rocker jaw body 14 can have a face 16. In one or more embodiments, the rocker jaw can be curved, or in another embodiment, the rocker jaw can be flat.

The rocker jaw body 14 can have one or more tong die grooves 18*a* and 18*b* formed in the face 16. The tong die grooves 18*a* and 18*b* can have groove edges 20*a* and 20*b* that incline towards a center line 22 as the groove edges extend from the rocker jaw body 14.

The rocker jaw body 14 can have a tong die 26*a* and 26*b* in each of the tong die grooves 18*a* and 18*b*. The tong dies 26*a* and 26*b* can have tooth beds 32*a* and 32*b*.

The rocker jaw body 14 can have a holding means 40 for each of the tong dies 26*a* and 26*b*, providing a holding compression to prevent the tong dies from sliding out of the tong die grooves 18*a* and 18*b*.

The rocker jaw body 14 can have a first side pair of flanges 42*a* and 42*b* extending from the rocker jaw body 14 and a second side pair of flanges 44*a* and 44*b* extending from the rocker jaw body 14. The flanges can be curved and resist deforming during movement.

Each side of the rocker jaw body can have an outer radius 50*a* and 50*b* that provides a flush fit between the rocker jaw body 14 and the rocker recess 54, as shown in FIG. 1.

FIG. 3B depicts a close up view of a tong die 26*a* according to one or more embodiments.

The tong die 26*a* is shown with the tooth bed 32*a*. The tooth bed 32*a* can support one or more teeth 34.

The tooth bed 32*a* have tooth bed edges 36*a* and 36*b* each having a slope 38*a* and 38*b* to provide a flush fit with the groove edges.

FIG. 3C depicts a cut view of the tong die 26*a* according to one or more embodiments.

The tong die 26*a* can have a back side depression 198, which can allow the tong die to be held by the holding means.

Figure 4:
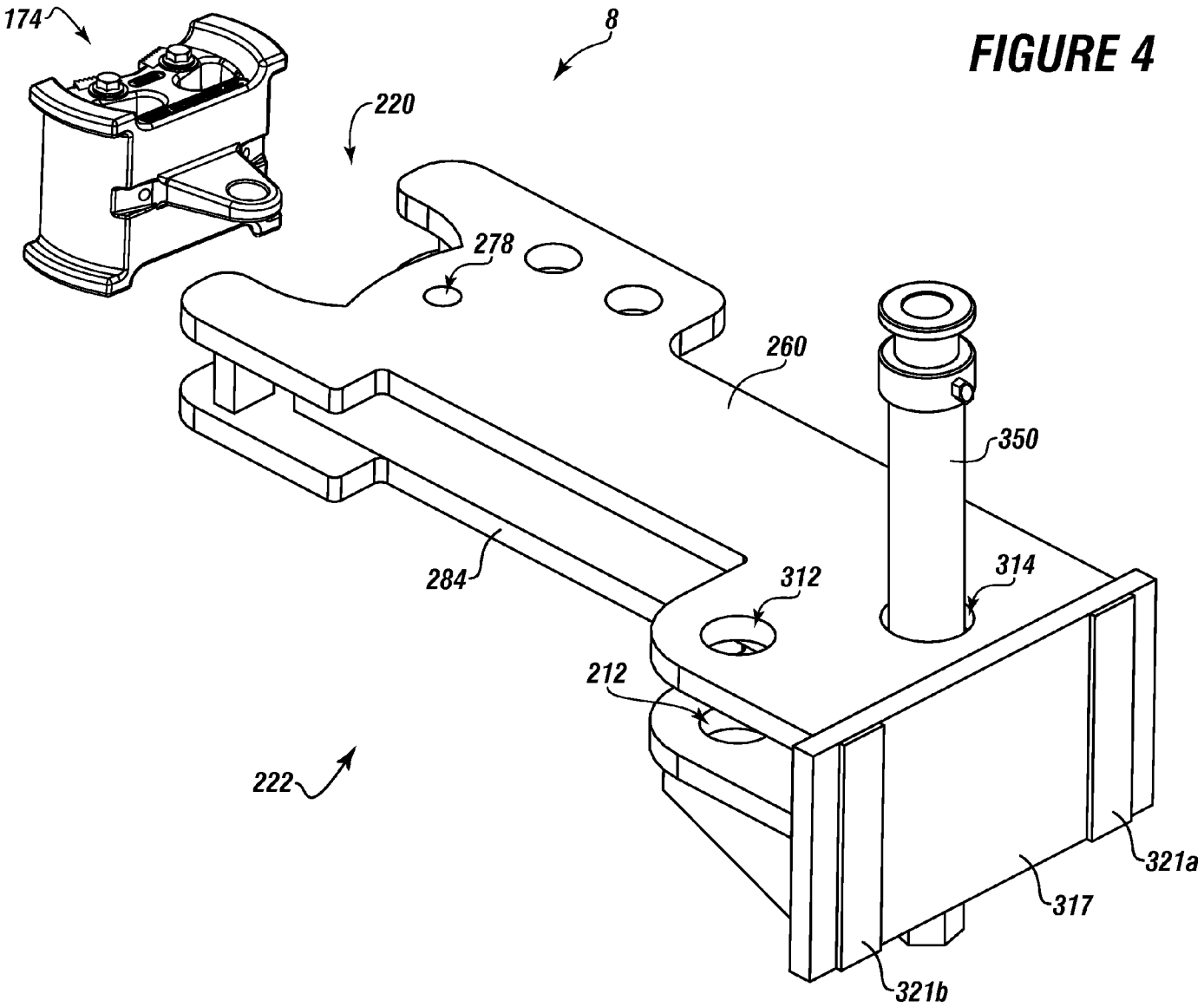
FIG. 4 depicts a backup arm frame according to one or more embodiments.

FIG. 4 depicts a backup arm 8 and a backup arm frame 222 according to one or more embodiments.

The backup arm 8 can include a backup arm frame 222 and a backup rocker jaw 174.

The backup arm frame 222 can include a backup top plate 260 and a backup bottom plate 284.

The backup arm frame 222 can have a backup rocker recess 220.

The backup rocker jaw 174 can be positioned in the backup rocker recess 220. The backup rocker jaw 174 can be attached to the backup arm frame 222 using the plate jaw fastener, which is not shown in this Figure. The plate jaw fastener can connect through the backup top fastening hole 278.

The backup arm frame 222 can have a backup back support plate 317 connected with the backup top plate 260 and backup bottom plate 284.

The backup back support plate 317 can have one or more backup back support plate spacers 321*a* and 321*b* connected vertically to the backup back support plate 317.

The backup bottom plate 284 can include a backup bottom chain cylinder connecting hole 212 and the backup top plate 260 can have a backup top chain cylinder connecting hole 312, which can be used to connect to a chain cylinder.

The backup arm frame 222 can have a backup top arm adjustment hole 314 in the backup top plate 260 and a backup bottom arm adjustment hole, not shown in this Figure, in the backup bottom plate for supporting a backup adjustment bolt 350.

Figure 5A:
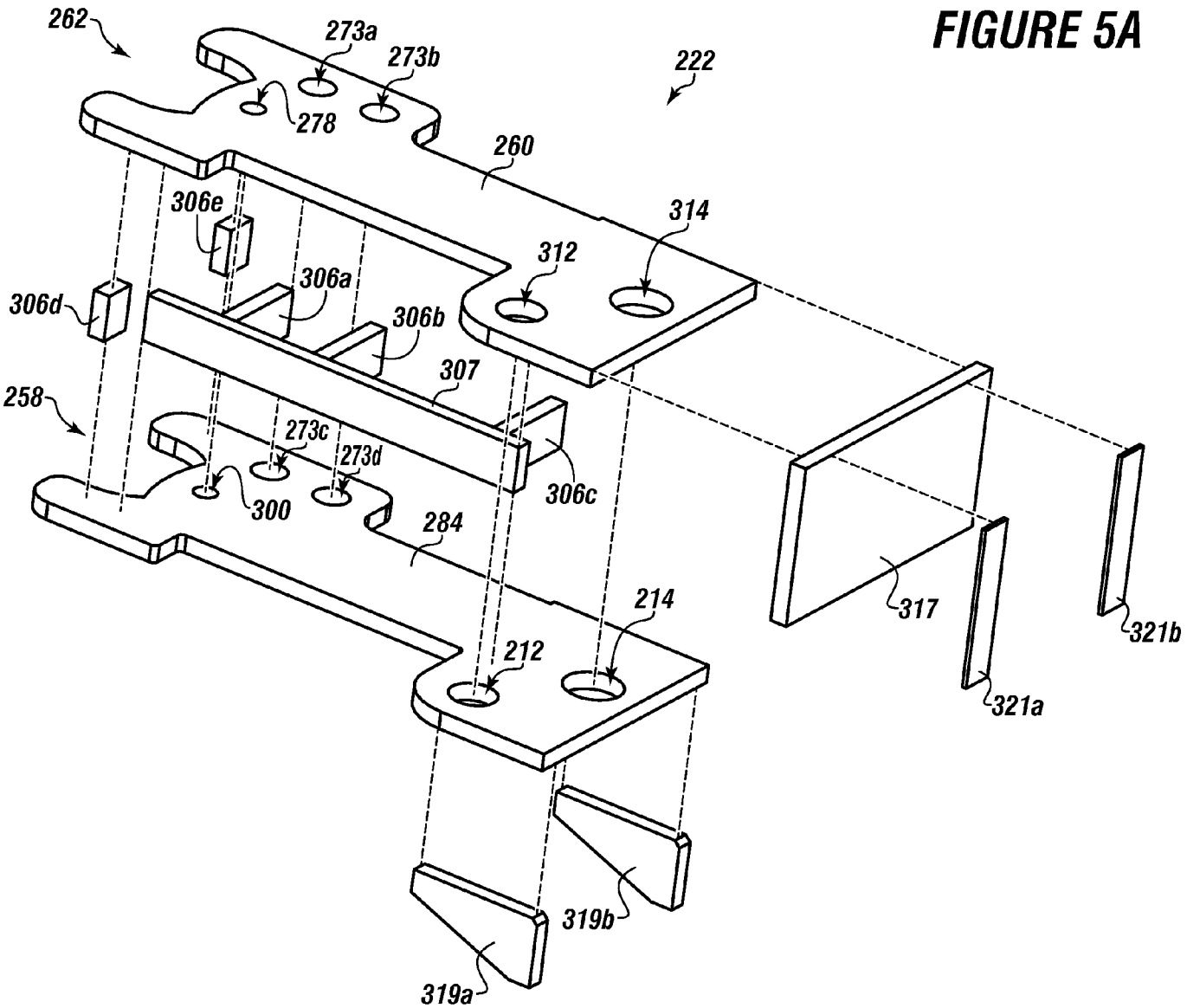
FIG. 5A depicts an exploded view of backup arm frame according to one or more embodiments.

FIG. 5A depicts an exploded view of the backup arm frame 222 according to one or more embodiments.

The backup arm frame 222 is shown having the backup top plate 260 with a backup top rocker recess portion 262.

The backup top plate 260 can have a backup top fastening hole 278 located next to the backup top rocker recess portion 262.

The backup top plate 260 can have a plurality of backup pin holes 273*a* and 273*b*, which can accept one or more backup pins that secure the backup rocker arm to the L-link or an adjustable link.

The backup arm frame 222 can have a backup bottom plate 284 with a backup bottom rocker recess portion 258.

The backup bottom plate 284 can have a backup bottom fastening hole 300 located next to the backup bottom rocker recess portion 258.

The backup bottom plate 284 can have a plurality of backup pin holes 273*c* and 273*d* for accepting the backup pins, which can secure the backup rocker arm to the L-link or the adjustable link.

The backup bottom plate 284 can have spacing bars 306*a*, 306*b*, 306*c*, 306*d*, and 306*e* separating the backup top plate and the backup bottom plate, which can align the holes and openings.

The backup bottom plate 284 can have a backup side support plate 307 connected between the backup top plate 260 and backup bottom plate 284.

The backup bottom plate 284 can have a backup back support plate 317 connected with the backup top plate 260 and backup bottom plate 284.

The backup bottom plate 284 can have a first backup angled support 319*a* and a second backup angled support 319*b* connected to the backup bottom plate 284.

The backup bottom plate 284 can have one or more backup back support plate spacers 321*a* and 321*b* connected vertically to the backup back support plate 317.

The backup arm frame 222 can have the backup top chain cylinder connecting hole 312 in the backup top plate 260 and a backup bottom chain cylinder connecting hole 212 in the backup bottom plate 284 for supporting the chain cylinder.

The backup arm frame 222 can have the backup top arm adjustment hole 314 in the backup top plate 260 and the backup bottom arm adjustment hole 214 in the backup bottom plate 284 for supporting a backup adjustment bolt.

Figure 5B:
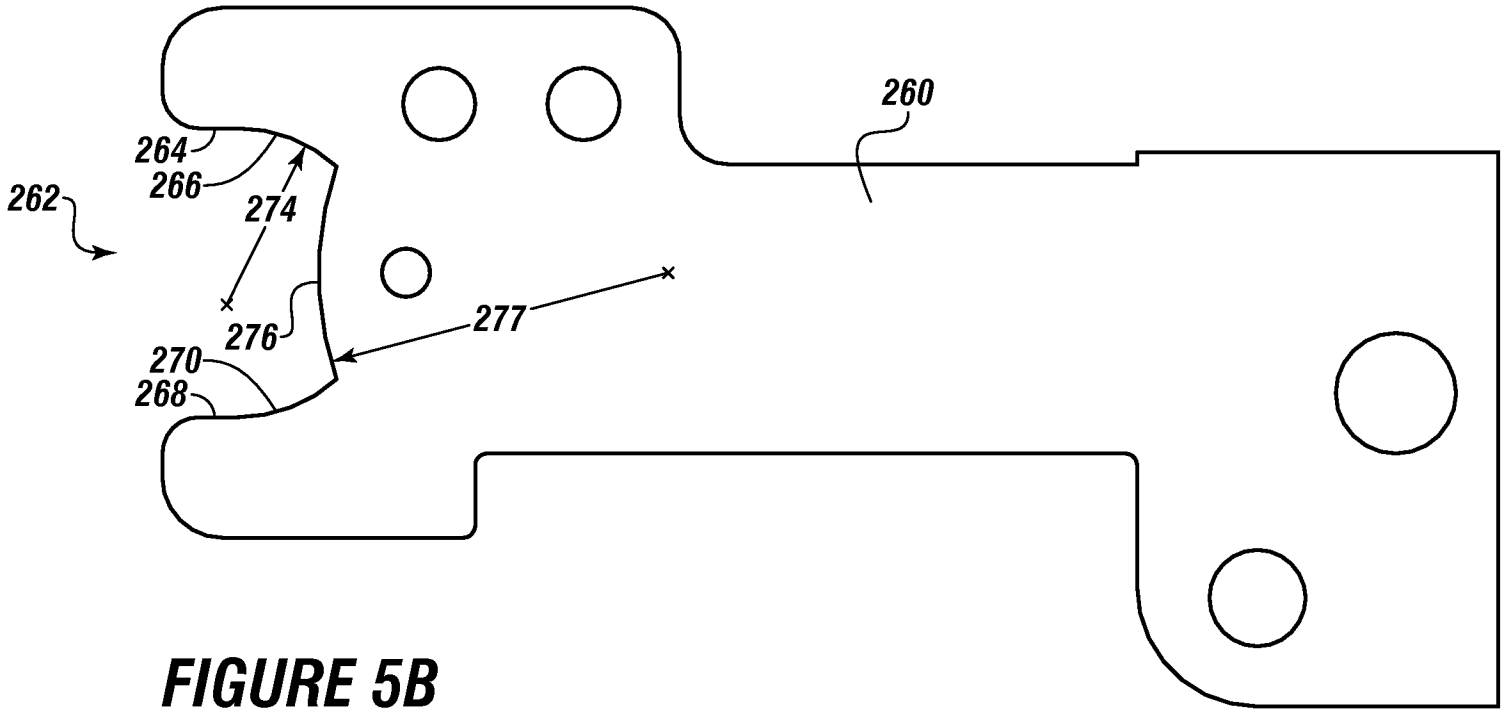
FIGS. 5B and 5C depict a top view of the backup top plate and the backup bottom plate, according to one or more embodiments.

FIG. 5B depicts a top view of the backup top plate 260 according to one or more embodiments.

The backup top plate 260 can have a backup top rocker recess portion 262.

The backup top rocker recess portion 262 can have a first backup top straight edge portion 264 which connects to a first backup top concave edge portion 266.

The backup top rocker recess portion 262 can have a second backup top straight edge portion 268, which connects to a second backup top concave edge portion 270.

The backup top rocker recess portion 262 can have a backup top concave edge radius 274 for each backup top concave edge portions.

The backup top rocker recess portion 262 can have a backup top convex edge 276 located between the first and second backup top concave edge portions, which can have a backup top convex edge radius 277.

Figure 5C:
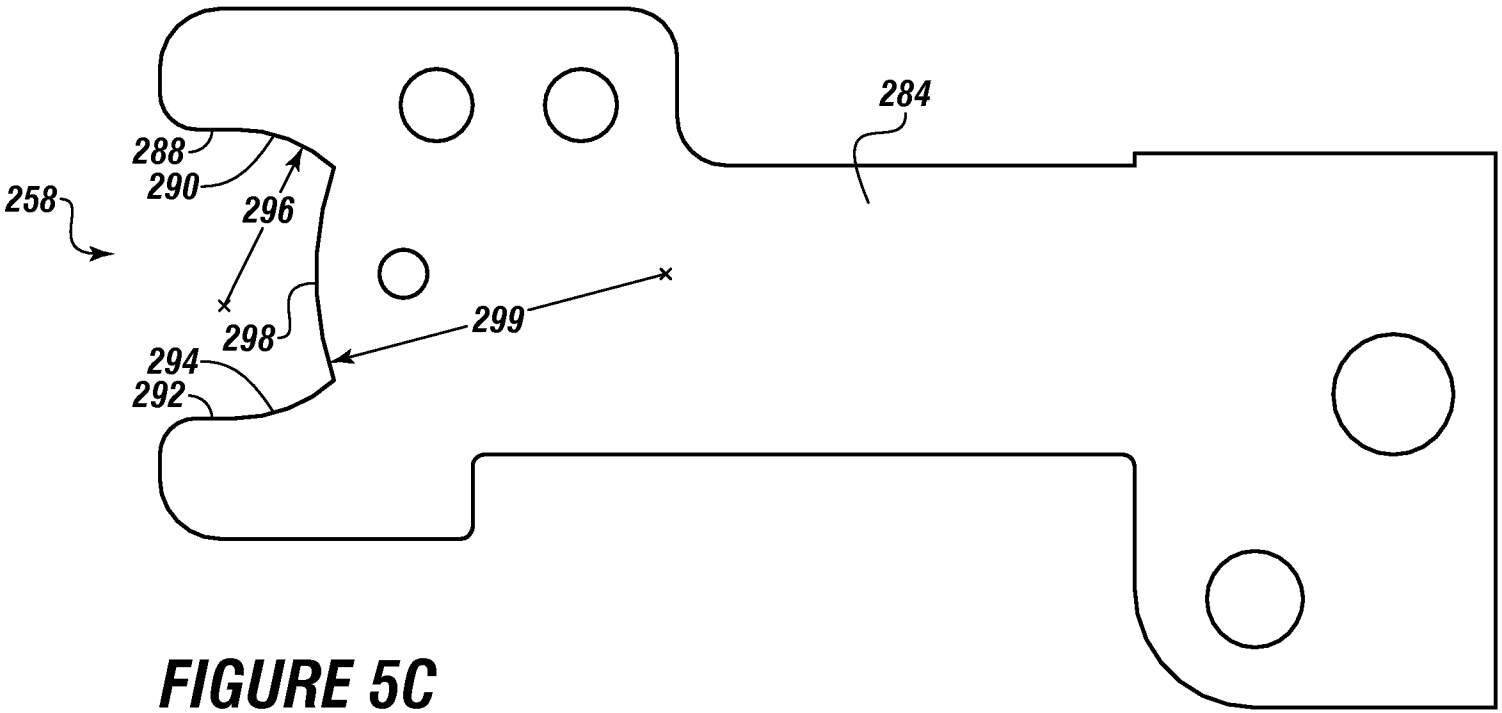

FIG. 5C depicts a top view of the backup bottom plate 284 according to one or more embodiments.

The backup bottom plate 284 is shown having the backup bottom rocker recess portion 258.

The backup bottom rocker recess portion 258 can have a first backup bottom straight edge portion 288 connected with a first backup bottom concave edge portion 290.

The backup bottom rocker recess portion 258 can have a second backup bottom straight edge portion 292 connected with a second backup bottom concave edge portion 294.

The backup bottom rocker recess portion 258 can have a backup bottom concave edge radius 296 for each backup bottom concave edge portion.

The backup bottom rocker recess portion 258 can have a backup bottom convex edge 298 connected between the first backup bottom concave edge portion 290 and second backup bottom concave edge portion 294, which can have a backup bottom convex radius 299.

Figure 6:
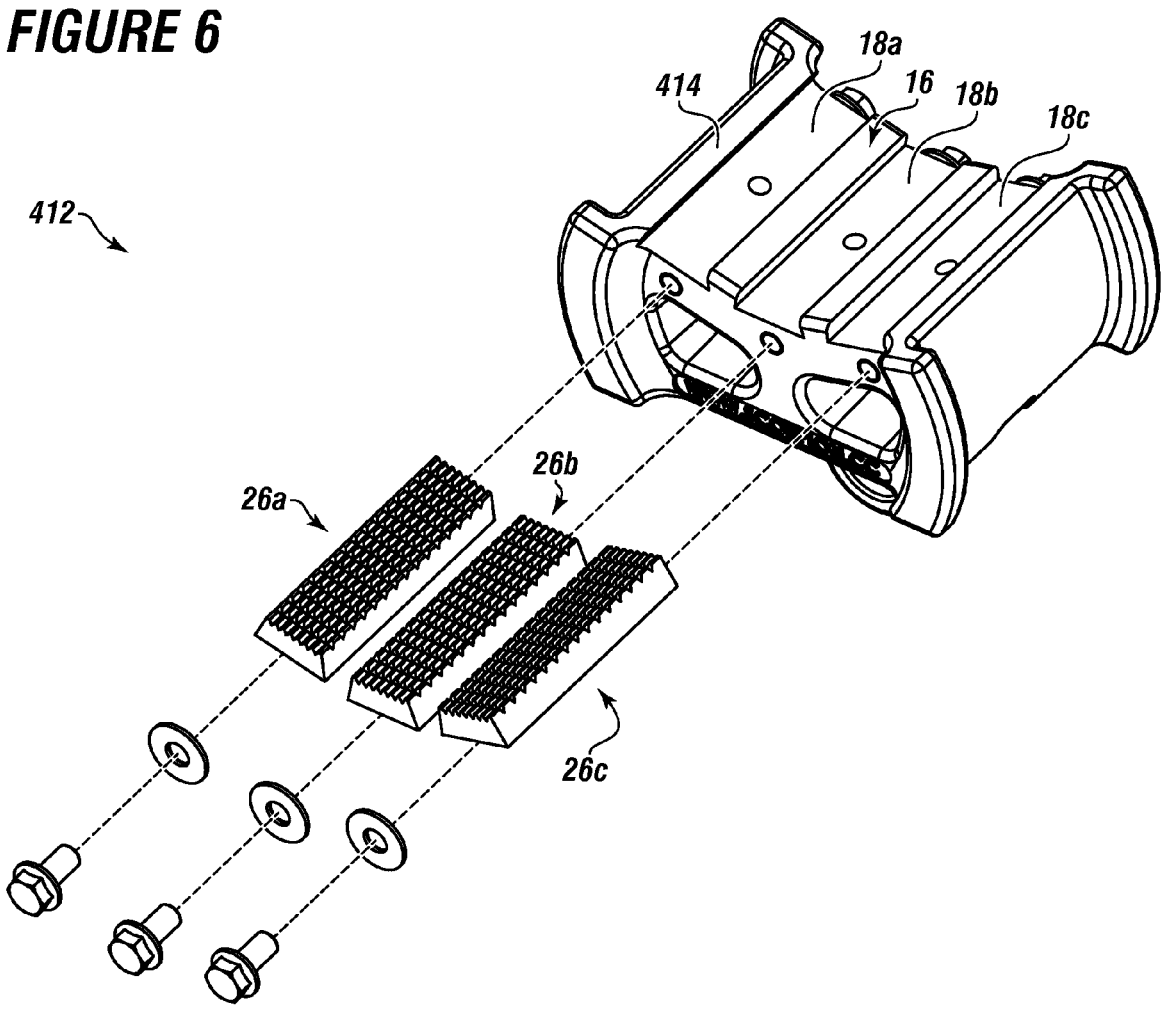
FIG. 6 depicts a three tong die rocker jaw according to one or more embodiments.

FIG. 6 depicts a three tong die rocker jaw 412 according to one or more embodiments.

The three tong die rocker jaw 412 can have a rocker jaw body 414 with a face 16.

The three tong die rocker jaw can have a plurality of tong die grooves 18*a*, 18*b* and 18*c* formed in the face 16.

The rocker jaw body 14 can have a tong die 26*a*, 26*b* and 26*c* in each of the tong die grooves 18*a*, 18*b* and 18*c*.

Figure 7:
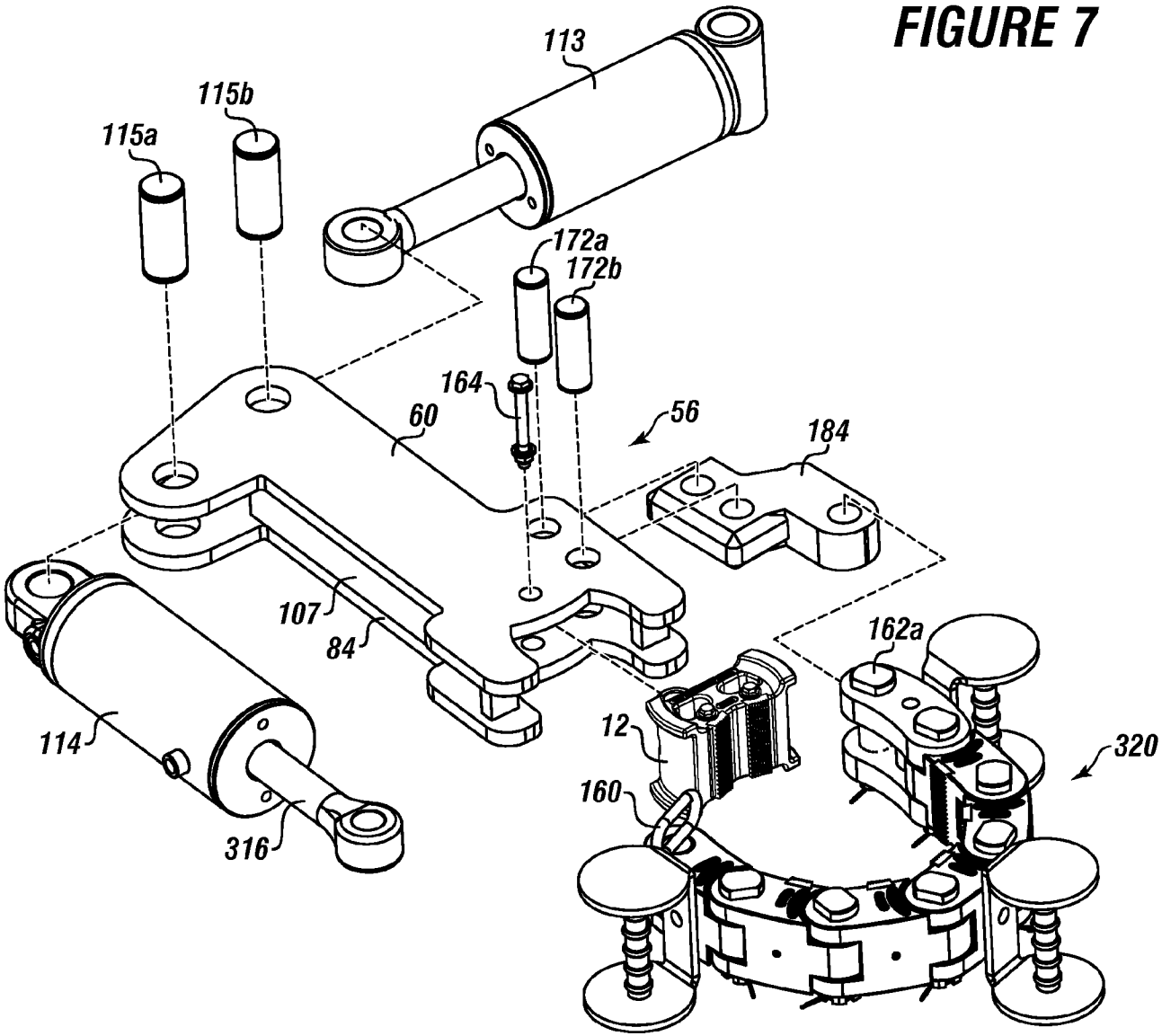
FIG. 7 depicts an exploded view of a chain link assembly with a rocker jaw according to one or more embodiments.

FIG. 7 depicts an exploded view of a chain link assembly with a rocker jaw according to one or more embodiments.

The chain link assembly can include the arm frame 56, the rocker jaw 12, and an L-link 184. Though this embodiment is described with the L-link 184, in another embodiment, an adjustable link can be used, which is described in later Figures. In another embodiment, no link is needed.

The arm frame can include the top plate 60, the bottom plate 84 and the side support plate 107. The rocker jaw 12 can be held in the arm frame 56 with the plate jaw fastener 164.

The arm frame 56 can have the accepting pins 172*a* and 172*b*. The accepting pins 172*a* and 172*b* can hold the L-link 184 in connection with the arm frame 56.

The L-link 184 can be connected with a chain attachment 320 with a hinge pin 162*a*.

A chain cylinder 114 can include a slidably hydraulically actuated piston rod 316. The chain attachment 320 can be connected with the slidably hydraulically actuated piston rod 316 with a locking pin 160.

The chain cylinder 114 can be connected to the arm frame 56 by a first cylinder connecting pin 115*a*.

The arm frame 56 can connect to a break-out cylinder 113. The break-out cylinder 113 can include a slidably hydraulically actuated piston rod.

The break-out cylinder 113 can be connected to the arm frame 56 by a second cylinder connecting pin 115*b*.

Figure 8:
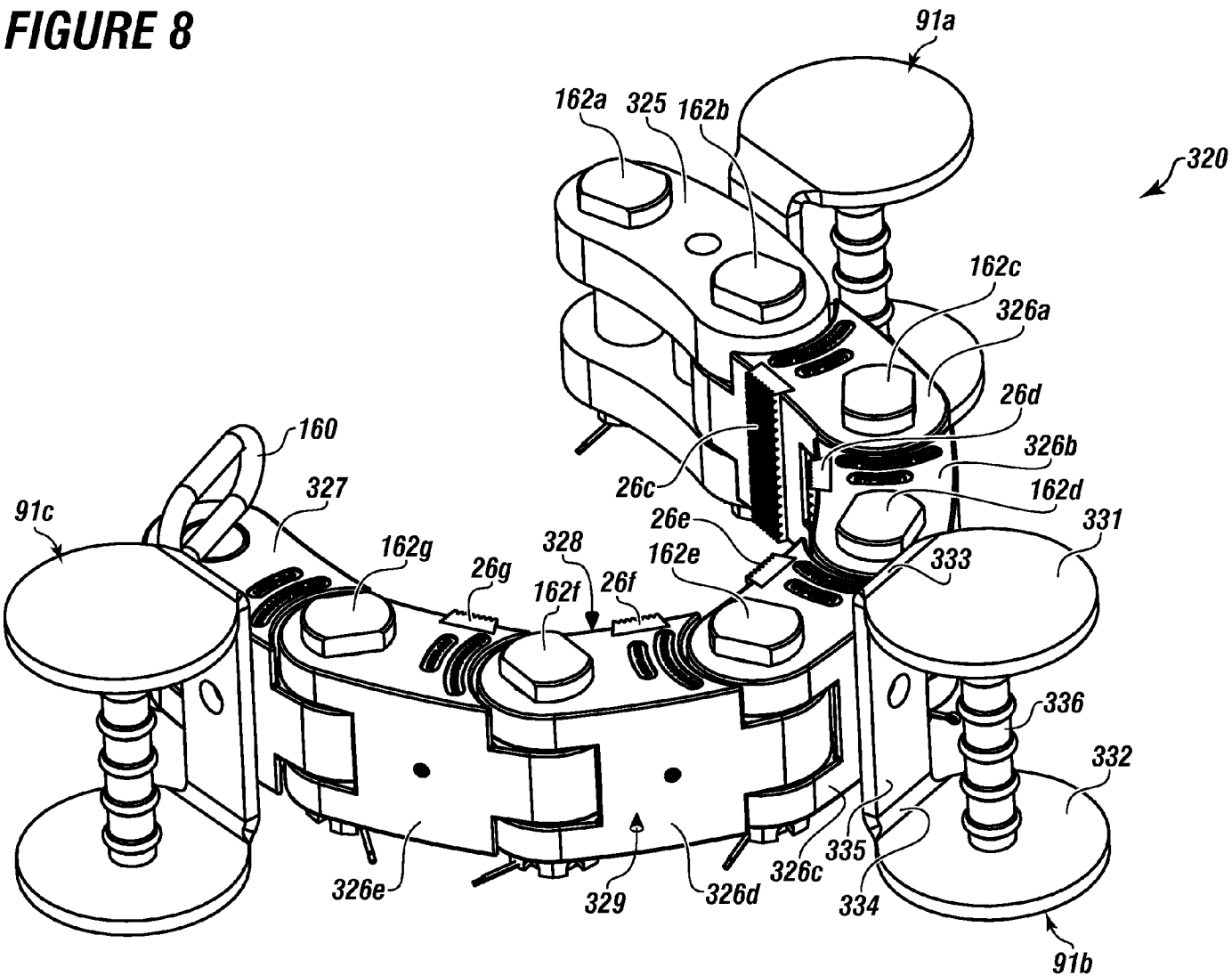
FIG. 8 depicts the chain attachment according to one or more embodiments.

FIG. 8 depicts the chain attachment 320 according to one or more embodiments.

The chain attachment 320 can include one or more chain links 326*a*, 326*b*, 326*c*, 326*d* and 326*e*, a locking link 327 and the connecting link 325. The chain links 326*a*-326*e* can be connected in series using one or more hinge pins 162*a*, 162*b*, 162*c*, 162*e*, 162*f* and 162*g*.

Each chain link can have a chain link face 328 and a chain link back 329.

The chain link face 328 can have a chain link tong die groove. The chain link tong die groove can have a tong die 26*c*, 26*d*, 26*e*, 26*f* and 26*g*.

The chain link series can be connected to the chain cylinder with the locking link 327. The locking link 327 can be connected to the chain link 326*e* using a hinge pin 162*g*. The locking link 327 can be connected to the chain cylinder using a locking pin 160.

The chain link backs 329 can be connected with handles 91*a*, 91*b* and 91*c*.

The handles 91*a*-91*c* can have an upper handle plate 331 with an upper flat edge 333, a lower handle plate 332 with a lower flat edge 334, an attachment plate 335 integrated with the upper flat edge 333 and the lower flat edge 334 which connects with the chain link back 329, and a gripping post 336 affixed between the upper handle plate 331 and the lower handle plate 332.

The handles 91*a*-91*c* can be connected to the connecting link 325, one of the chain links 326*a*-326*e* and the locking link 327.

The connecting link 325 can be connected to the chain link 326*a* with hinge pin 162*b*. The connecting link 325 can be connected to the arm frame, the L-link or the adjustable link with hinge pin 162*a*.

Figure 9A:
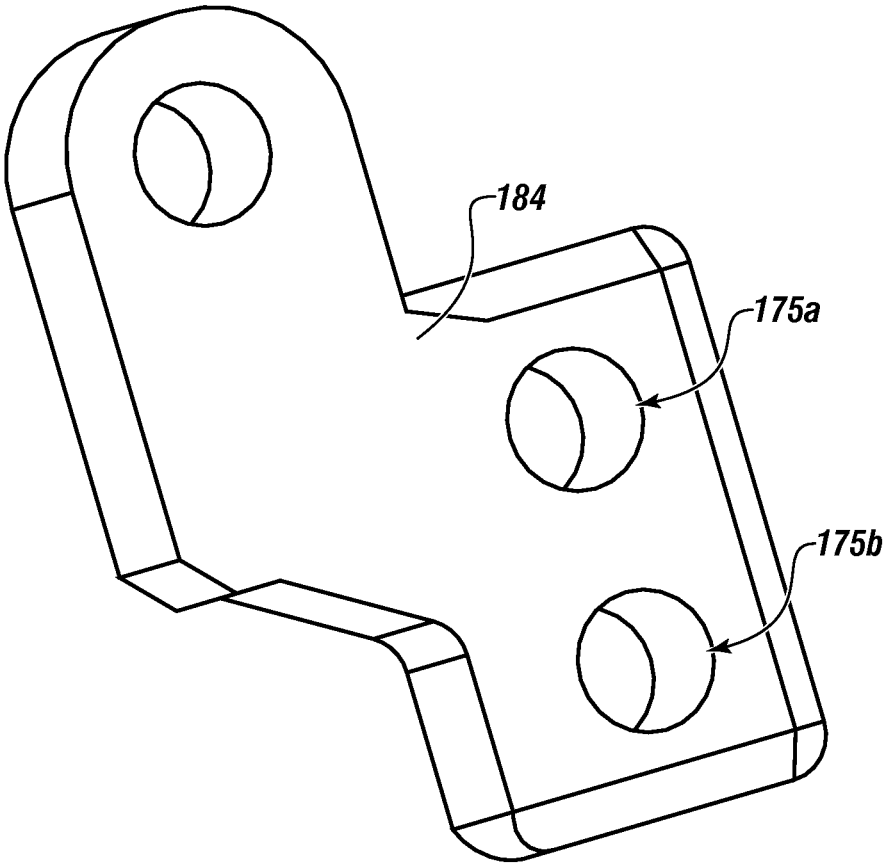
FIG. 9A depicts the L-link according to one or more embodiments.

FIG. 9A depicts the L-link according to one or more embodiments.

The L-link 184 can have L-link receiving holes 175*a* and 175*b*, for receiving the accepting pins described in earlier Figures.

Figure 9B:
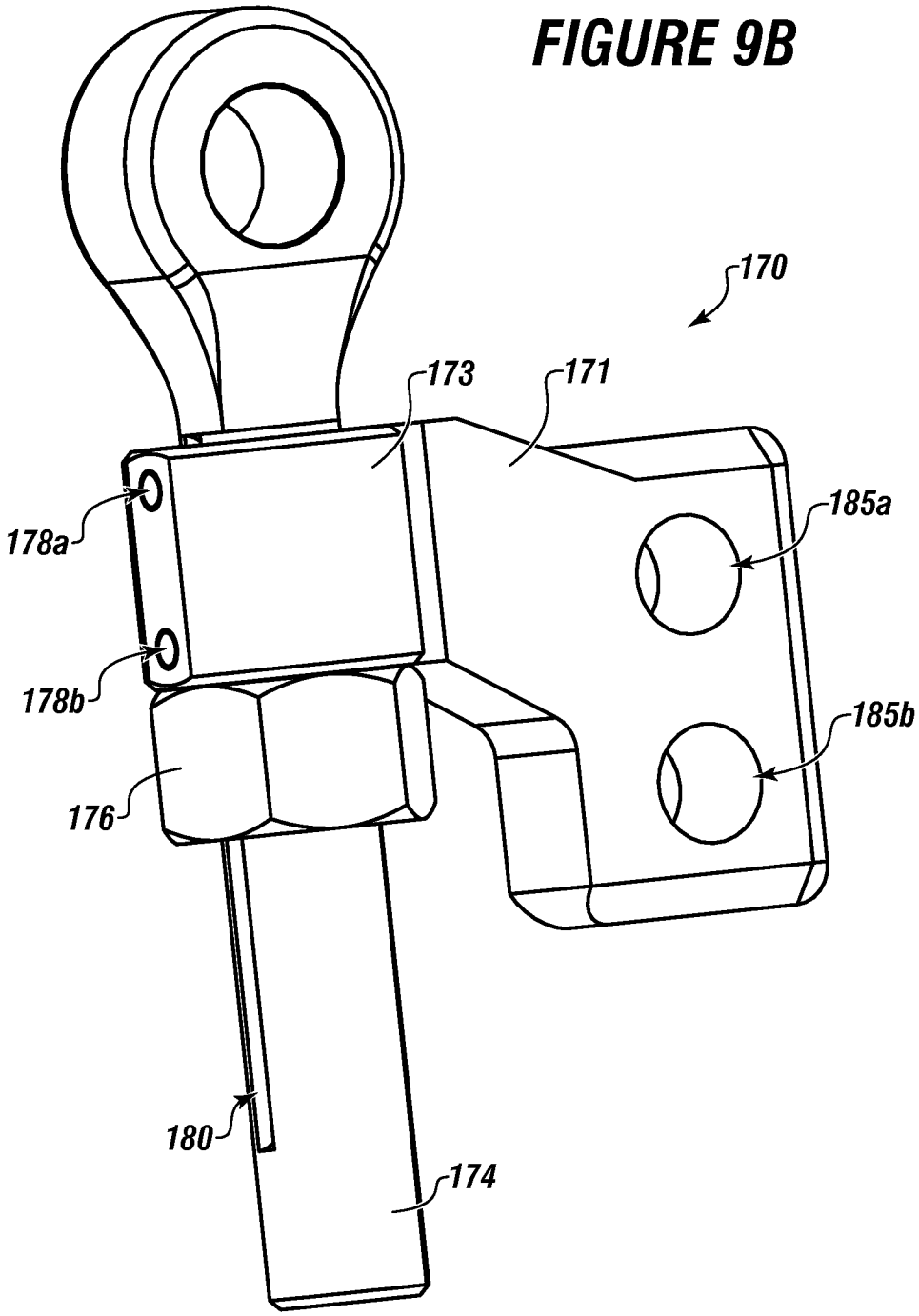
FIG. 9B depicts an adjustable link according to one or more embodiments.

FIG. 9B depicts the adjustable link 170, according to one or more embodiments.

The adjustable link 170 can have an adjustable link bracket 171 which is connected with an adjuster bolt receiving end 173.

The adjustable link bracket 171 can have one or more adjustable link receiving holes 185*a* and 185*b*, for receiving the plurality of pins.

The adjuster bolt receiving end 173 can have at least one aligning set screw 178*a* and 178*b*.

The adjuster bolt receiving end 173 can engage with a bolt 174. An adjuster nut 176 can be engaged with the bolt 174 and in connection with the adjuster bolt receiving end 173.

The bolt 174 can have at least one alignment groove 180. The bolt can be oriented using the one or more aligning set screws 178*a* and 178*b*.

While these embodiments have been described with emphasis on the embodiments, it should be understood that within the scope of the appended claims, the embodiments might be practiced other than as specifically described herein.

What is claimed is:

1. A tong assembly with a make-up/break-out arm, wherein the make-up/break-out arm engages a tubular comprising:

a. the make-up/break-out arm comprising:

(i) an arm frame comprising:

(1) a top plate with a top rocker recess portion, wherein the top rocker recess portion comprises:

(a) a first straight edge portion sequentially connecting a first concave edge portion;

(b) a second straight edge portion sequentially connecting to a second concave edge portion;

(c) a concave edge radius for each concave edge portion;

(d) a convex edge disposed between the first and second concave edge portions, having a convex edge radius which is configured to allow pivoting of the rocker jaw;

(e) a top fastening hole disposed proximate to the top rocker recess portion; and (f) a plurality of pin holes for each accepting pins; and (2) a bottom plate with a bottom rocker recess portion, wherein the bottom rocker recess portion comprises:

(a) a bottom first straight edge portion sequentially connecting a bottom first concave edge portion;

(b) a bottom second straight edge portion sequentially connecting to a bottom second concave edge portion;

(c) a bottom concave edge radius for each bottom edge portion;

(d) a bottom convex edge disposed between the bottom first and bottom second concave edge portions, having a bottom convex radius which is configured to allow pivoting of the rocker jaw;

(e) a bottom fastening hole disposed proximate to the bottom rocker recess;

(f) one or more pin holes for accepting the accepting pins;

(g) spacing bars separating the top and bottom plates, aligning the holes and openings; and (h) a break-out cylinder connecting hole for supporting a break-out cylinder;

(ii) a chain cylinder connecting hole for supporting a chain cylinder;

(iii) a rocker recess formed between the top rocker recess portion and the bottom rocker recess portion;

(iv) a rocker jaw fastened between the top and bottom plates and movably within the rocker recess, wherein the rocker jaw comprises:

(1) a rocker jaw body comprising:

(a) a face;

(b) a plurality of tong die grooves formed in the face, each groove has groove edges;

(c) a tong die in each of the tong die grooves;

(d) a holding means for each tong die providing a holding compression to prevent the tong die from sliding out of the tong die groove;

(e) a first side pair of flanges extending from the rocker jaw body and a second side pair of flanges and extending from the rocker jaw body, wherein each flange is curved and resists deforming during movement;

(f) a tail extending from the rocker jaw body opposite the face between the top and bottom plates, wherein the tail comprises a tail hole; and (g) wherein the rocker jaw body has an outer radius that allows for a continuous contact between the rocker body and the rocker recess;

(v) a plate jaw fastener, inserted through the top fastening hole and the bottom fastening hole, retaining the rocker jaw between the top and bottom plate by engaging the tail hole of the rocker jaw body; and (vi) cylinder connecting pins connecting the arm frame with the break-out cylinder and the chain cylinder.

2. The tong assembly of claim 1, wherein the accepting pins for one or more pin holes connect an L-link or an adjustable link with the backup arm frame.

3. The tong assembly of claim 2, wherein the L-link connects between the top plate and the bottom plate using the accepting pins.

4. The tong assembly of claim 1, wherein the break-out cylinder is connected between the top plates and the bottom plate using the cylinder connecting pin.

5. The tong assembly of claim 1, wherein the first side pair of flanges and the second side pair of flanges each have bevels at a base thereof allowing the rocker jaw to move in the arm frame to hold the tubular during make-up and break-out.

6. The tong assembly of claim 1, wherein the face comprises three parallel tong die grooves and a tong die in one or more parallel tong die groove.

7. The tong assembly of claim 1, wherein the holding means is a detent or a fastener.

8. The tong assembly of claim 1, wherein the first side pair of flanges and the second side pair of flanges are connected with an outside surface of the top plate and the bottom plate or connected with the an inside surface of the top plate and the bottom plate.

9. The tong assembly of claim 1, wherein the rocker jaw body further comprises:

a. a first body cavity and a second body cavity extending from a top side into the rocker jaw body; and b. a third body cavity and a fourth body cavity extending from a bottom side into the rocker jaw body.

10. The tong assembly of claim 1, wherein each tong die further comprises a depression in a back side thereof for containing the holding means.

11. The tong assembly of claim 1, further comprising an L-link connected with the arm frame, wherein a connecting link attaches one or more chain links connected in series to the L-link, and wherein the chain links are connected with a locking link to a chain cylinder for connecting around a pipe outer diameter; wherein the chain cylinder connects between the top plate and the bottom plate using the cylinder connecting pin; and wherein each chain link comprises:

a. a chain link face;

b. a chain link back;

c. at least one tong die groove formed in each chain link face having groove edges; and d. a tong die slidably inserted in each of the tong die grooves.

12. The tong assembly of claim 11, further comprising a plurality of handles attached with the connecting link, the one or more chain links, or the locking link.

13. The tong assembly of claim 12, wherein each handle comprises:

a. an upper handle plate with an upper flat edge;

b. a lower handle plate with a lower flat edge;

c. an attachment plate integral with the upper flat edge and integral with the lower flat edge and extending between the upper handle plate and the lower handle plate; and d. a gripping post affixed between the upper handle plate and the lower handle plate.

14. The tong assembly of claim 11, wherein each of the chain links is connected in series to the L-link using hinge pins.

15. The tong assembly of claim 1, wherein the top convex edge and the bottom convex edge each comprise an acute triangle with a planar face.

16. The tong assembly of claim 1, further comprising a side support plate connected between the top and bottom plates.

17. The tong assembly of claim 1, further comprising a backup arm connected with the make-up/break-out arm, wherein the arms are spaced apart from each other, and wherein both arms engage the tubular enabling the tong assembly to provide make-up and break-out of tubulars, wherein the backup arm comprises:

a. a backup rocker jaw, wherein the backup rocker jaw comprises:

(i) a backup rocker jaw body comprising:

(1) a backup face having one or more backup tong die grooves with backup groove edges;

(2) a backup tong die in each of the backup tong die grooves;

(3) a backup holding means for each backup tong die providing a holding compression to prevent the backup tong die from sliding out of the backup tong die groove;

(4) a first side pair of backup flanges extending from the backup rocker jaw body and a second side pair of backup flanges extending from the backup rocker jaw body, wherein each backup flange is curved and does not deform during movement; and (5) a backup tail extending from the backup rocker jaw body with a backup tail hole; and (6) wherein the backup rocker jaw body has a backup outer diameter that provides a flush fit between the backup rocker jaw body and backup concave edges of a backup rocker recess of a backup arm frame;

(ii) the backup arm frame comprising:

(1) a backup top plate with a backup top rocker recess portion, wherein the backup top rocker recess portion comprises:

(a) a first backup straight edge portion sequentially connecting a first backup concave edge portion;

(b) a second backup straight edge portion sequentially connecting to a second backup concave edge portion;

(c) a backup concave edge radius for each backup concave edge portion;

(d) a backup convex edge disposed between the first and second backup concave edge portions, having a backup convex edge radius;

(e) a backup top fastening hole disposed proximate to the backup top rocker recess portion; and (f) a plurality of backup pin holes for accepting one or more backup pins;

(iii) a backup bottom plate with a backup bottom rocker recess portion, wherein the backup bottom rocker recess portion comprises:

(1) a backup bottom first straight edge portion connecting with a backup bottom first concave edge portion;

(2) a backup bottom second straight edge portion connecting with a backup bottom second concave edge portion;

(3) a backup bottom concave edge radius for each backup bottom edge portion;

(4) a backup bottom convex edge disposed between the backup bottom first second concave edge portion and backup bottom second concave edge portion, having a backup bottom convex radius;

(5) a backup bottom fastening hole disposed proximate to the backup bottom rocker recess portion;

(6) a plurality of backup pin holes for accepting the backup pins;

(7) spacing bars separating the backup top and backup bottom plates aligning the holes and openings;

(8) a backup side support plate connected between the backup top and backup bottom plates;

(9) a backup back support plate between the backup top and backup bottom plates;

(10) a first backup angled support and a second backup angled support between the backup top and backup bottom plates; and

(11) a backup top chain cylinder connecting hole in the backup top plate and a backup bottom chain cylinder connecting hole in the backup bottom plate for supporting the chain cylinder; and (iv) the backup plate jaw fastener retaining the backup rocker jaw body between the top and bottom plate by engaging the tail hole of the tail of the rocker jaw body.

18. The tong assembly of claim 17, wherein the accepting pins and for the plurality of pin holes and connect an L-link or an adjustable link with the backup arm frame.

19. The tong assembly of claim 17, further comprising an L-link connected with the backup arm frame, wherein a connecting link attaches one or more chain links connected in series to the L-link, and wherein the chain links are connected with a locking link to a chain cylinder for connecting around a pipe outer diameter; wherein the chain cylinder connects between the backup top plate and the backup bottom plate using the cylinder connecting pin; and wherein each chain link comprises:

a. a chain link face;

b. a chain link back;

c. at least one tong die groove formed in each chain link face having groove edges; and d. a tong die slidably inserted in each of the tong die grooves.

* * * * *